US005730478A

United States Patent [19]

D'Hooge

[11] Patent Number: 5,730,478

[45] Date of Patent: Mar. 24, 1998

[54] METHOD AND APPARATUS FOR MOUNTING A PUSH/PULL HANDLE ON A LATCH

[75] Inventor: Richard E. D'Hooge, Wooddale, Ill.

[73] Assignee: Architectural Builders Hardware Manufacturing, Inc., Ill.

[21] Appl. No.: 678,250

[22] Filed: Jul. 11, 1996

[51] Int. Cl.[6] ..... E05B 3/00

[52] U.S. Cl. ..... 292/348; 292/165; 292/357; 292/DIG. 53

[58] Field of Search ..... 292/DIG. 53, 348, 292/357, 356, 92, 165

[56] References Cited

U.S. PATENT DOCUMENTS

| | | | |
|---|---|---|---|
| 1,715,975 | 6/1929 | Angell | 411/166 |
| 2,991,107 | 7/1961 | Eichacker et al. | 292/92 |
| 3,894,759 | 7/1975 | Balducci | 292/92 |
| 3,897,092 | 7/1975 | Atkins | 292/92 |
| 4,007,954 | 2/1977 | Erickson | 292/92 |
| 4,192,536 | 3/1980 | Laureano | 292/228 |
| 4,629,228 | 12/1986 | Marko et al. | 292/165 |
| 4,789,191 | 12/1988 | Dennis | 292/348 |
| 5,029,916 | 7/1991 | Chiu | 292/336.3 |
| 5,085,474 | 2/1992 | Toledo et al. | 292/92 |
| 5,403,047 | 4/1995 | Walls | 292/173 |

*Primary Examiner*—Rodney M. Lindsey
*Attorney, Agent, or Firm*—Patnaude Videbeck & Marsh

[57] ABSTRACT

Method and apparatus for mounting a push/pull handle on a latch mechanism is disclosed. Recently, it has become desirable for large medical service facilities, such as hospitals, to change their door latch mechanisms from rotatable lever handles to push/pull handles. The apparatus comprises a pair of mating adapter plates mountable on either side of a door outwardly adjacent a mortise lock presently mounted in the door. The adapter plates include a plurality of pairs of aligned apertures, each of the several pairs of which are adapted to align with a pair of apertures which differing lock manufacturers position in differing radial and arcuate positions with respect to a mortise operating key. The adapter plates fasten through the mortise to the respective door sides and allow push/pull type handle assemblies to be mounted on the adapter plates so as to be operatively connected through the mortise operating key. In the method, the rotatable door handles are removed from the door and latch mechanism, the adapter plates are mounted on the sides of the door outwardly adjacent the mortise. The push/pull handle assemblies are then mountable on the adapter plates and operable through the mortise operating key.

10 Claims, 7 Drawing Sheets

METHOD AND APPARATUS FOR MOUNTING A PUSH/PULL HANDLE ON A LATCH

The present invention relates to push/pull door latches, and in particular to the method and apparatus for modifying an existing door latch having a rotatable type handle so as to accommodate a push/pull type handle.

BACKGROUND OF THE INVENTION

The push/pull type door handle enables a door to be opened inwardly into a room by pushing on an outside handle or pulling on an inside handle. Such handles incorporate a cam which causes the pushing or pulling movement of the handle to rotate an elongate key extending perpendicularly through the mortise of the lock. The push/pull type handle is particularly useful in hospitals, and their use is encouraged by governmental agencies because they are easier to use by disabled persons. Although they are generally installed in the more recently constructed hospitals, many older hospitals still have lever handles which must be rotated to open the latch.

An older hospital may have door latches from several different manufacturers, and each manufacturer offers a push/pull handle which is compatible with its lock assembly. As a result, a hospital which seeks to convert its doors from rotatable lever handles to push/pull handles may have to bear the expense of replacing not only the handles, but the entire lock assembly and perhaps the cost of replacing all the doors to its rooms.

It would be desirable, therefore, to provide a method whereby the lever handles of many manufacturers can be removed from their associated lock assemblies, and replacement push/pull handles attached without ordering parts from the lock manufacturer.

SUMMARY OF THE INVENTION

Briefly, the present invention is embodied in a method for adapting a door lock which has a lever-type handle to receive a push/pull type handle. Typically, such door locks have a mortise having a thickness narrower than the door in which it is embedded, such that a thin panel of wood from which the door is made extends across each side of the mortise. The mortise is retained within the door by a plurality of bolts which extend through holes at given locations in the mortise, and through the adjacent side panels of the door. Such door locks also have a rotatable key having a rectangular cross section, which extends through the central portion of the mortise perpendicular to the side faces. The existing lever handles are attached to the key such that rotation of one of the handles rotates the key and causes the tenon to be withdrawn within the mortise.

To convert the handles of such a door, the lever handles are first removed from the key, and the plurality of bolts which extend through the transverse holes at given locations in the mortise are also removed. Thereafter, adapter plates, according to the present invention, are positioned on opposite sides of the door, where each adaptor plate has a central opening for receiving the distal end of the key, and a first plurality of holes aligned to receive bolts extending through the transverse holes at the given locations through the mortise. In the preferred embodiment, each of such bolts has a tapered head which fits flush with the outer surface of a plate into which it has been inserted, and each bolt is threaded into a tapered nut which is fitted into a complementarily shaped hole in one of the adapter plates such that the outer surfaces of the nut will be flush with the outer surface of the adapter plate. The adaptor plates further have a second plurality of threaded holes positioned to receive the mounting screws of a push/pull handle. A push/pull handle assembly having a rotatable cam with a central opening sized to receive the end of the key is then fitted over the distal ends of the key which extend from each side of the door, and the desired push/pull handle assembly is attached to the adapter plates by screws extending through a base plate of the push/pull handle and into the second plurality of threaded holes on the adaptor plate.

The primary manufacturers of door locks of the type suitable to receive a push/pull handle, sell locks under the trade names PDQ/Almet, Yale, Arrow, Falcon, Best, Corbin, ABH, and Schlage. The mortise manufactured by each of these companies has a key with a square cross section, and the dimensions of the cross-sectional area of such keys differ between the manufacturers. Similarly, each of the mortises is retained within a door by extending bolts through two transverse holes at diametrically opposing locations with respect to the key, with each manufacturer having differing given positions for the location of such mounting holes. In the preferred embodiment, however, the mounting plate of the present invention has a central opening sufficiently large to receive the key of any of the lock manufacturers, and surrounding the central opening are a plurality of holes positioned to receive the mounting bolts from a number of the lock manufacturers. In the preferred embodiment, two configurations of mounting plates are required to accept mounting bolts through the mortises of all of the above-mentioned manufacturers.

Although there are no standardized cross-sectional dimensions for the key, many of the manufacturers employ keys having identical cross-sectional dimensions such that only three sizes of square central openings are required in the cams of push/pull handles to accept keys from all of the foregoing manufacturers.

GENERAL DESCRIPTION OF THE DRAWINGS

A more complete understanding of the invention will be had from a reading of the following detailed description taken in conjunction with the accompanying drawings wherein.

DETAILED DESCRIPTION OF THE PREFERRED EMBODIMENT

Figure 2:
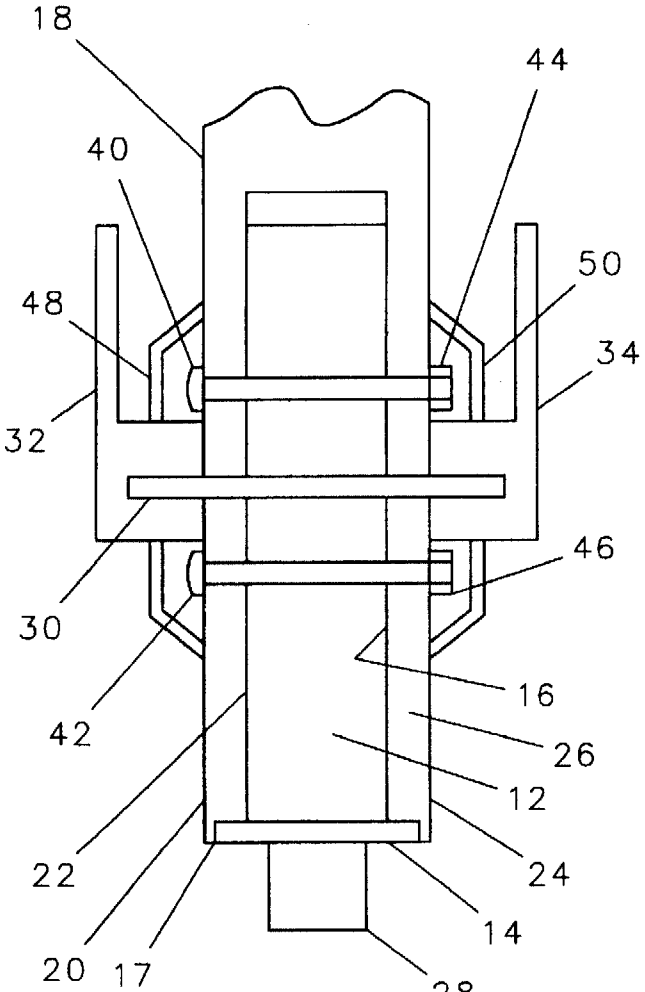
PRIOR ART FIG. 2
FIG. 2 is a cross-sectional view of a door having the mortise of FIG. 1 fitted therein, and having first and second rotatable lever handles attached to opposite sides of the door.
Figure 1:
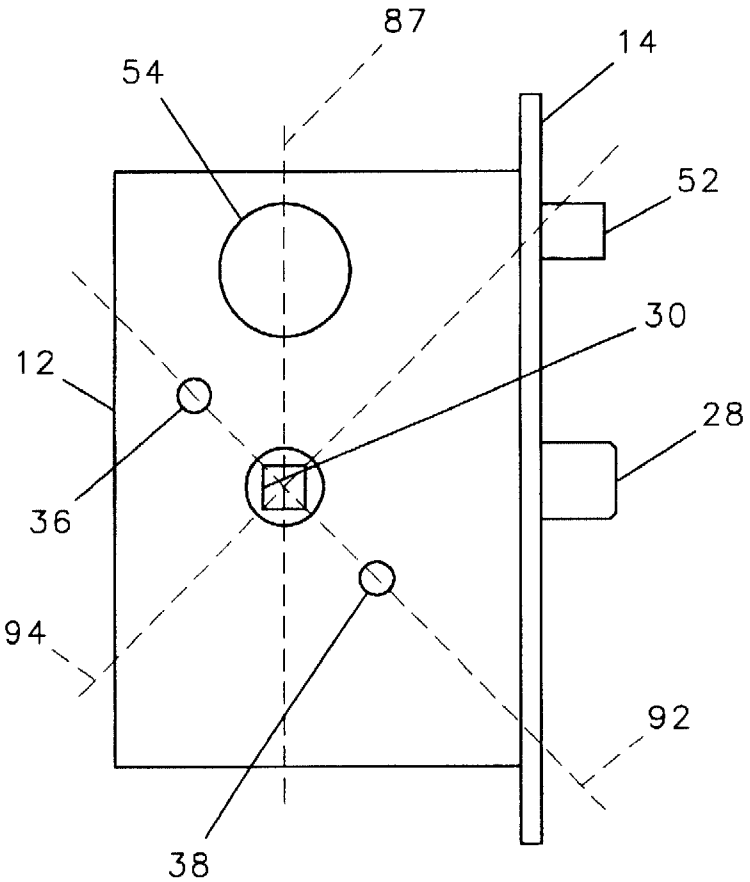
PRIOR ART FIG. 1
FIG. 1 is a side elevational view of a mortise for insertion in a door of the type having a rectangular transverse key extending through the mortise.

Referring to FIGS. 1 and 2, a door lock has a generally rectangular mortise 12 at the forward end of which is an end member 14. As seen in FIG. 2, the mortise 12 of the lock is fitted into a deep groove 16 in an end 17 of a door 18, with the outer surface of the end member 14 fitted flush with the end 17 of the door. The mortise 12 is substantially thinner than the thickness of the door 18, and where the door is made of wood, a wood panel 20 extends across one of the faces 22 of the mortise 12, and a second panel 24 extends across the second face 26. The lock further has a retractable tenon 28 which is withdrawn into the mortise when a key 30, having a square cross section, which extends transversely through a square hole 31 in the mortise 12, is rotated by one of the lever handles 32, 34.

Also extending transversely through the mortise 12 are first and second transverse holes 36, 38, respectively, at given locations determined by the manufacturer so as not to interfere with the mechanism of the lock. To retain the mortise 12 within the door 18, first and second bolts 40, 42 are extended through the transverse holes 36, 38 and the adjacent side panels 20, 24, and are retained in position by nuts 44, 46 at the distal ends thereof. The heads of the bolts 40, 42 on one side of the door, and the nuts 44, 46 on the other side of the door are enclosed under covers 48, 50 which are retained against the outer surface of the door, and each of the manufacturers has its own structure for retaining the cover against the surface of the door.

The lock may further include a dead bolt 52 operated from a separate key assembly 54 which may or may not be mechanically connected to the assembly for withdrawing the tenon 28.

Figure 3:
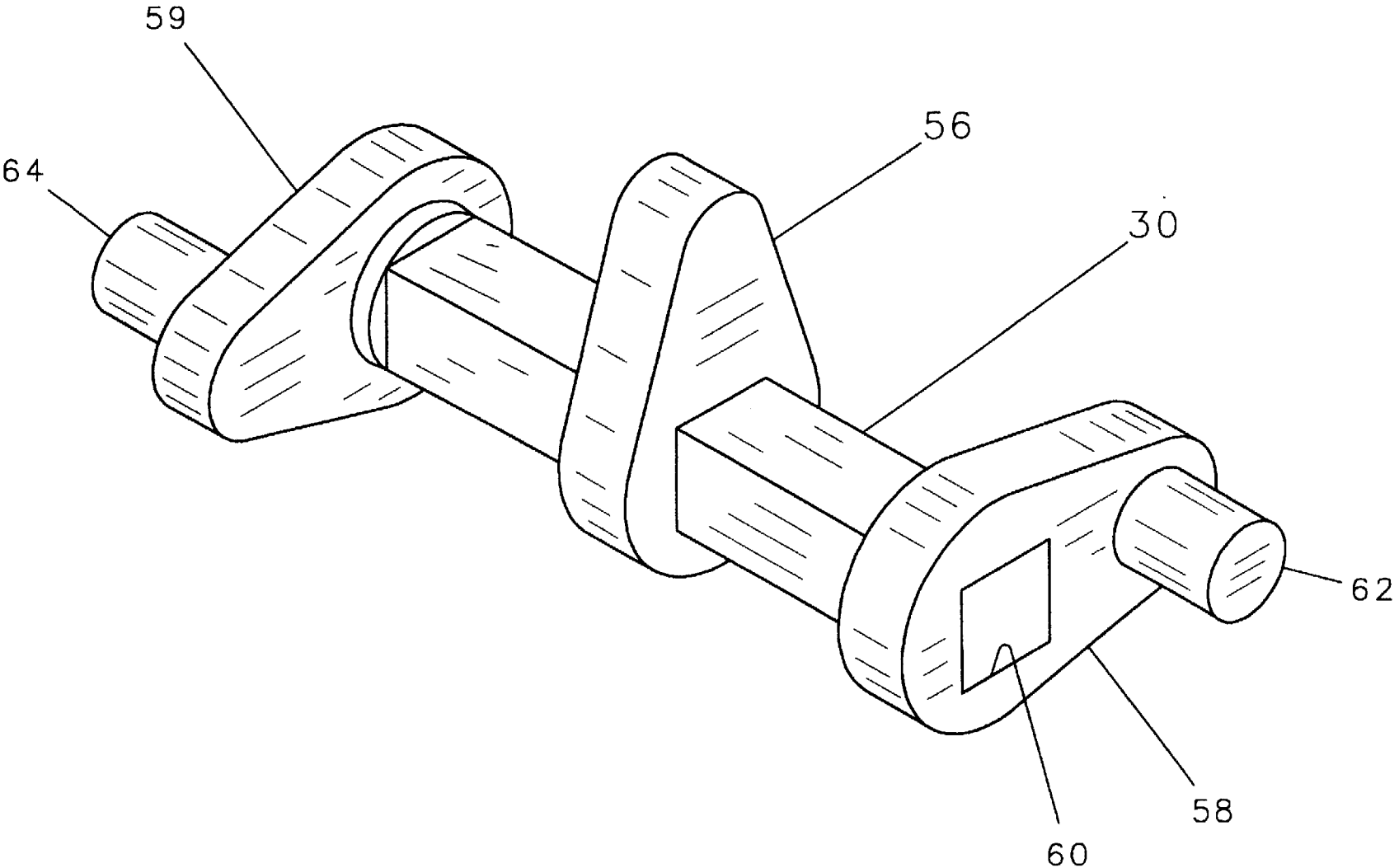
FIG. 3 is an isometric view of a key and cam assembly for operating the lock shown in FIG. 1.

Referring to FIG. 3, to rotate the key 30 and a cam 56 to thereby retract the tenon, each end of the key 30 has a cam 58, 59 fitted thereon, each of which has an opening sized to non-rotatably receive the key 30, only one of which 60 is shown, and each of the cams 58, 59 has an axially extending off center peg 62, 64 respectively. The movement of peg 62 upward, as shown in FIG. 3, or the movement of peg 64 downward, will rotate the key 30 counterclockwise as shown, and retract the tenon.

Figure 4:
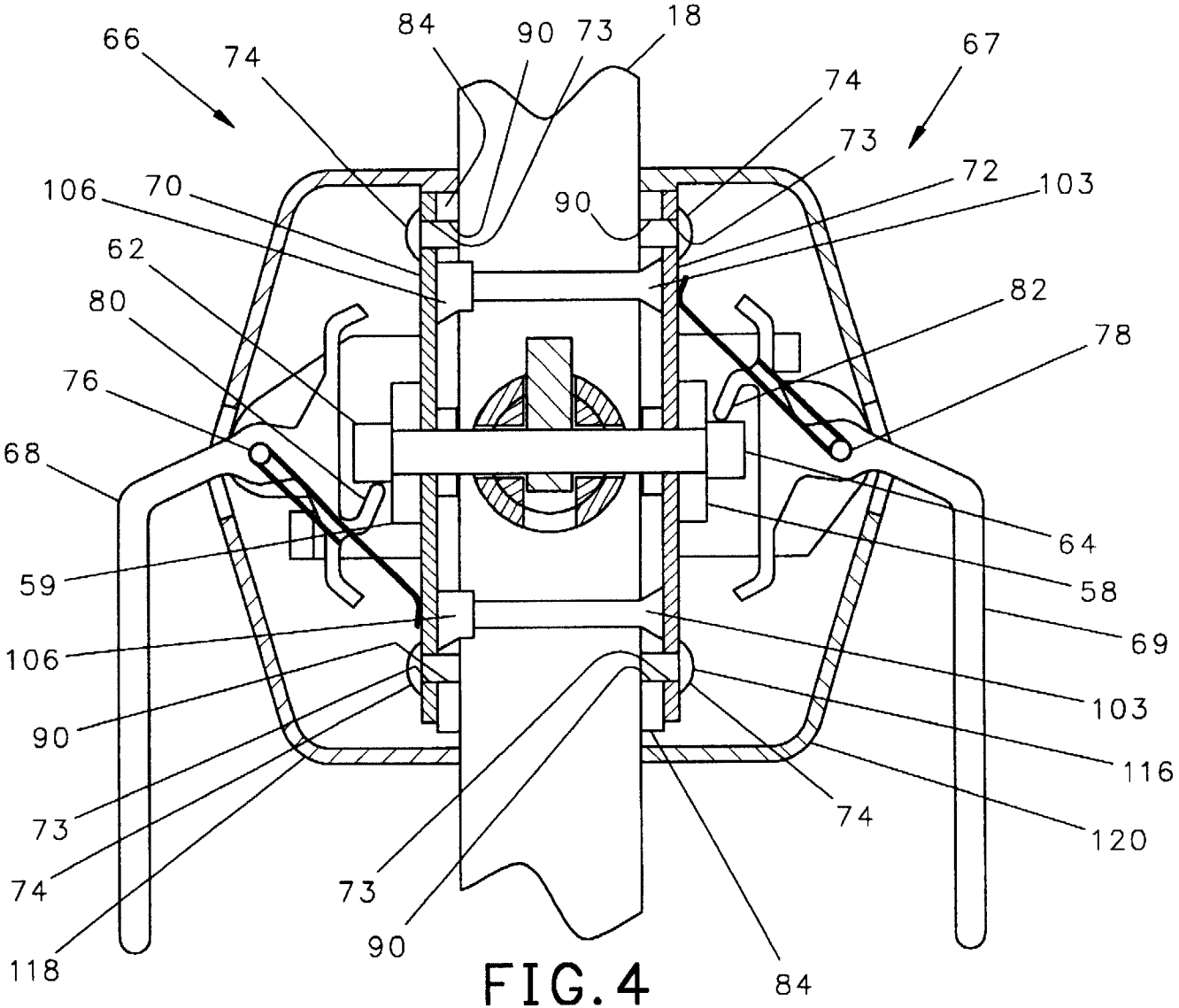
FIG. 4 is a cross-sectional view of a door and mortise of a lock adapted to be fitted with push/pull handles in accordance with the present invention.

As best shown in FIG. 4, in which a push handle assembly 66 is depicted as being on one side of the door 18, and a pull handle assembly 67 on the other side, the assemblies 66, 67 have associated handles 68, 69 which are pivotably mounted on brackets 70, 72, respectively. Each mounting bracket has a plurality of spaced mounting holes 73—73 through which mounting bolts 74—74 extend. Each of the handles 68, 69 rotates on a pivot pin 76, 78, respectively, and has a foot 80, 82, respectively, to engage the peg 62, 64 on the associated cam 58, 59 and rotate the cam by pushing the push handle 66 or pulling the pull handle 68.

To replace the lever handles 32, 34 of the lock as shown in FIG. 2 with push/pull handles of the type shown in FIG. 4, the covers 48, 50 and the lever handles 32, 43 are removed from each side of the door 18. Thereafter, the nuts 44, 46 are removed from the associated bolts 40, 42 and the bolts are withdrawn from the holes 36, 38 and from the associated holes in the side panels 20, 24 of the door.

Figure 6:
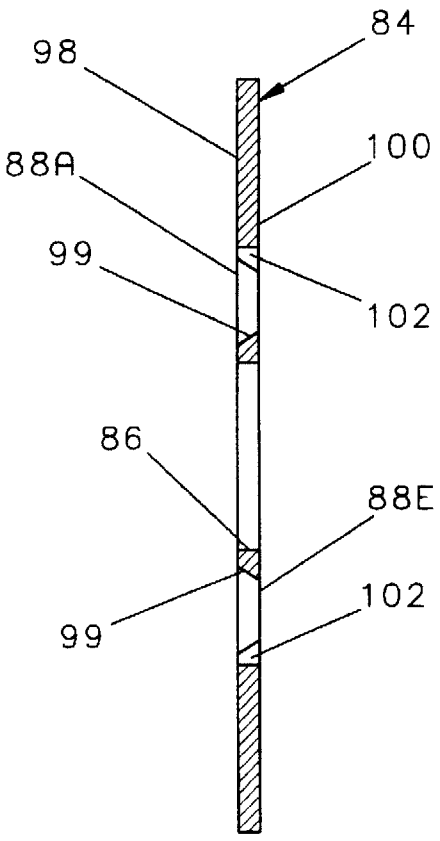
FIG. 6 is a cross-sectional view of the adaptor plate shown in FIG. 5 taken through lines 6—6 thereof.
Figure 5:
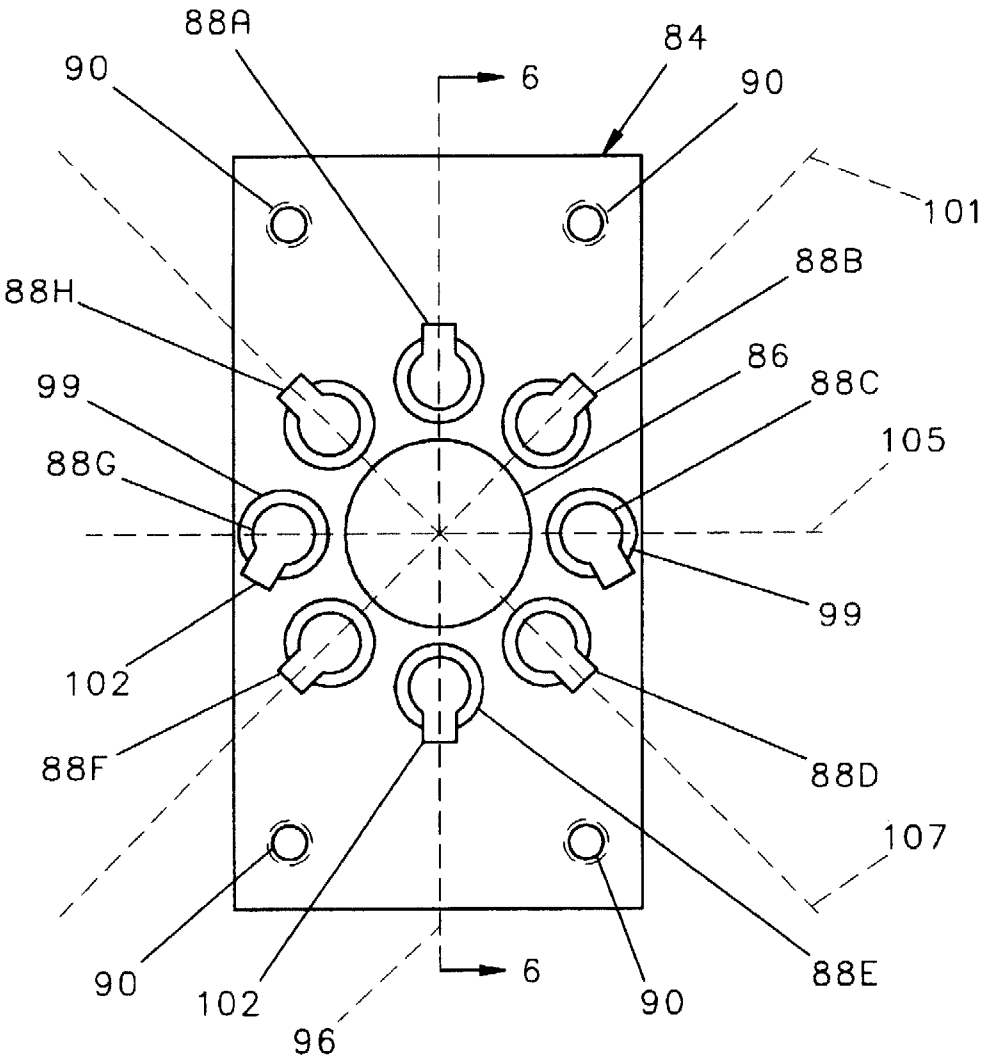
FIG. 5 is a front elevational view of an adaptor plate constructed in accordance with the present invention.
Figure 8:
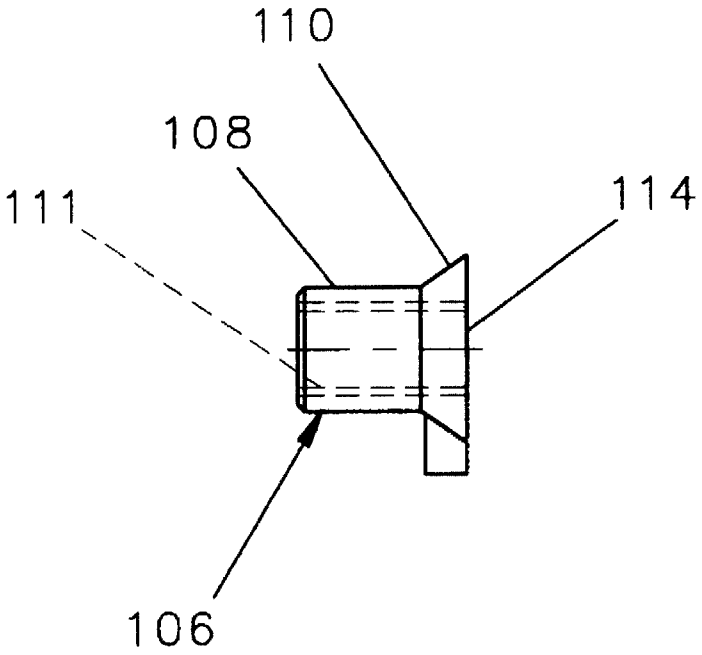
FIG. 8 is a side view of the mounting nut first embodiment shown in FIG. 7 with the interior shown in phantom lines.
Figure 7:
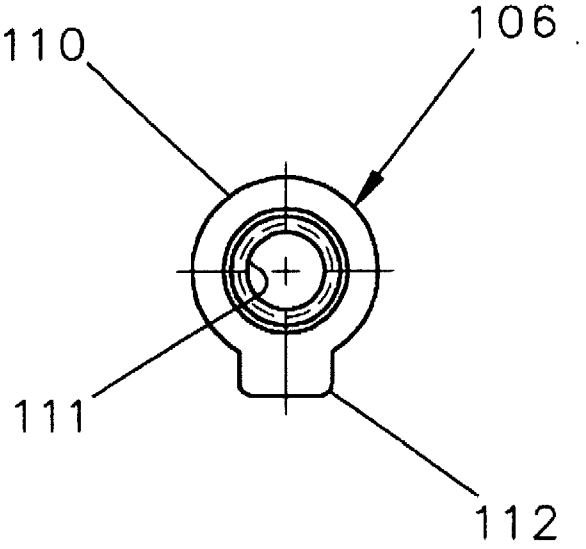
FIG. 7 is an enlarged front elevational view of a first embodiment of a mounting nut constructed in accordance with the present invention.

Referring to FIGS. 4, 5 and 6, an adapter plate 84 constructed in accordance with the present invention has a centrally located transverse hole 86 having a diameter sufficiently large to receive the key 30 having the largest cross-sectional dimensions of any lock manufactured for which the plate 84 is to be used. The plate 84 further has a first plurality of retaining holes 88A–88H positioned around the central opening 86 which are adapted to receive bolts which extend through the transverse holes 36, 38 of the locks of more than one manufacturer as is further described below. The plate 84 further has a second plurality of threaded holes 90—90 which, in the preferred embodiment are positioned one at each corner thereof for receiving mounting bolts which extend through the mounting holes 73—73 in the brackets 70, 72.

Referring to FIGS. 1, 4, 5, and 6, the transverse holes 36, 38 are depicted as being positioned one on each side of the central opening 86 along a line 92 which is at a 45 degree angle with respect to a perpendicular. This configuration of transverse holes 36, 38, can be found in locks sold under the trademarks PDQ, Yale, Arrow, and Best, and the configuration of holes for locks from these manufacturers differ only in their spacings. The mortise of locks sold under the trademark Schlage, on the other hand, have two holes, one on opposite sides of the hole 31 along a line 94 which is perpendicular to the alignment of holes along line 92 shown in FIG. 1. Locks sold under the trademarks Falcon and Corbin, on the ocher hand, have mounting holes corresponding to transverse holes 36, 38 which are positioned along a vertical line 87 extending through the center of the hole 31. To accommodate the mounting holes for more than one of the manufacturers of locks, the first plurality of holes 88A–88H of the adaptor plate 84 consists of eight holes.

It should be appreciated that the push/pull handles can be mounted so that the handles pivot about either a horizontal axis or a vertical axis. Whereas some customers desire push/pull handles to be mounted on a vertical axis, others want their handles to be mounted for movement about a horizontal axis, and the plate 84 may, therefore, be mounted with its longitudinal axis 96 extending either vertically or horizontally.

The holes 88B and 88F are spaced from each other a distance equal to the given spacing between the holes 36 and 38 for one of the manufacturers of locks and being positioned along a line 101 which is 45 degrees from the perpendicular. Accordingly, when the plate 84 is positioned on a door with a lock therein from a manufacturer for which the plate 84 is adapted to fit, the key 30 will extend through the central opening 86 of the plate, and the holes 88B and 88F can be aligned over the transverse holes 36, 38, respectively, of the lock. Similarly, holes 88D and 88H are positioned along line 107 which is perpendicular to line 101, and these holes are also spaced from each other a distance which is equal to the distance between holes 36 and 38 of the same manufacturer such that when the plate 84 is positioned over the distal end of the key 30 which extends from the opposite side of the door, holes 88D and 88H will also align over the holes 36, 38.

In similar fashion, the holes 88A and 88F are positioned along the vertical axis 96 and are spaced to receive bolts extending through mounting holes in a mortise of a different manufacturer. The spacing between holes 88C and 88G is identical to the spacing between holes 88A and 88E, and is positioned along the horizontal axis 105, so that the plate 84 may be mounted to accept a push/pull handle oriented to rotate about either a horizontal axis or a vertical axis.

As can be seen in FIGS. 5 and 6, each of the holes 88A–88H has a taper 99—99 with the widest portion at its outer surface 98 and the narrowest portion at the inner surface 100. Further, each hole 88A–88H has a rectangular notch 102—102. The taper of the holes 88A–88H in the plate 84 is sized to receive the tapered head of a commonly available bolt 103, shown only in FIG. 4, sized such that when the inner surface of the head of the bolt is against the taper 99 of the plate 84, the outer surface of the bolt head will be flush with the outer surface 98 of the plate 84.

Figure 9:
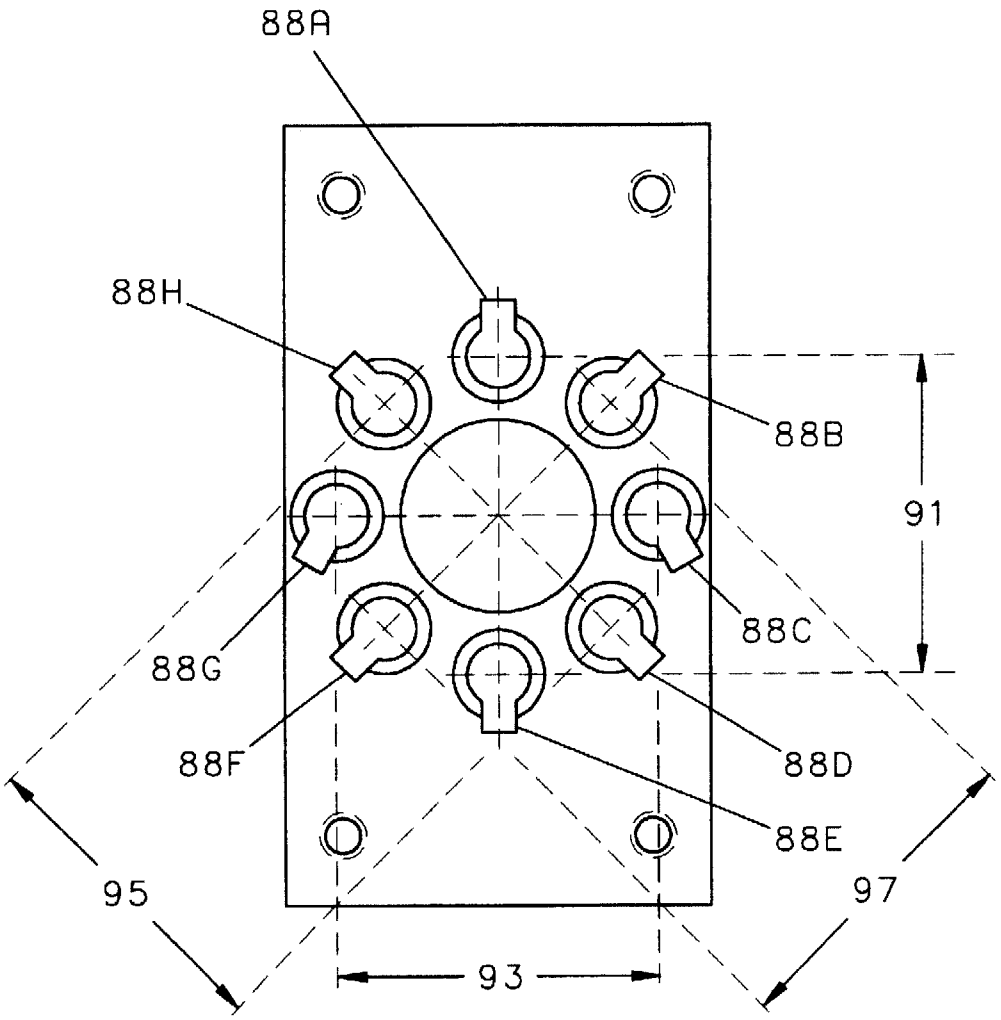
FIG. 9 is a second front elevational view of the adaptor plate shown in FIG. 5 with certain dimensions designated.

Referring to FIG. 9, although the spacing between the holes 36, 38 in the mortise of some manufacturers match the spacing between the holes of others, the spacings of the holes for certain other manufacturers are somewhat different, and a single plate 84 cannot be made with holes 88A–88H which receive bolts through the mortises of all the major manufacturers. To accommodate hole spacings for the mortise sold under the trademarks PDQ, Yale, Arrow, Best, Schlage, Falcon and Corbin, two separate configurations of plate 84 are required. Since the only difference between the two configurations of plate 84 is the spacings between the holes, FIG. 9 can be used to discuss both configurations.

To accommodate the spacings of holes 36, 38 for the mortise manufactured by Corbin and Schlage, spacing 91 between holes 88A and 88E is equal to the spacing 93 between holes 88G and 88C, the spacings 91 and 93 being 1.516 inches, center-to-center. Also, the spacing 95 between holes 88H and 88D equals the spacing 97 between holes 88F and 88B, the spacings 95 and 97 being 1.532 center-to-center. To accommodate the spacings of holes 36, 38 for the locks sold under the trademarks Falcon, PDQ and Best, the spacing 91, 93, 95 and 97 between the holes 88A–88H are all equal to each other, the spacings all being 1.688 inches center-to-center.

Referring further to FIGS. 4, 5, and 6, one plate 84 is retained against each side of the door 18 by the bolts 103—103 which extend through the transverse holes 36, 38 of the mortise, the panels 20, 24 of the door, and the appropriate holes 88A–88H of the plate 84 which are spaced and aligned to receive the bolts 103—103. Since the heads of each of the bolts 103—103 has a taper complementary to the taper 99 of the holes 88A–88H, the heads of the bolts fit flush with the outer surfaces 98—98 of the plates 84—84, and the bolt heads do not interfere with portions of the brackets 70, 72 when they are fitted against the plates 84—84.

Referring to FIGS. 4, 5, 6, 7 and 8, the bolts 103—103 are retained by nuts 106—106, each of which has a generally cylindrical body 108 and a generally frustoconical distal end 110 and a threaded axial bore 111. The frustoconical end 110 is broken by a tab 112. The diameter of the cylindrical body 108 is sized to fit slidably through the holes 88A–88H of the adapter plate 84, with the frustoconical end 110 sized to fit within the tapered portion 99 thereof and the tab 112 sized to fit within the notch 102 of the hole 88A–88H to prevent rotation of the nut 106 after assembly of the lock within a door.

The outer surface 114 of each of the nuts 106—106 is flat so as to be flush with the outer surfaces 98 of the plate 84 and not obstruct portions of the brackets 70, 72 of the push/pull assemblies 66, 67.

After the adaptor plates 84—84 are bolted to each side of the door 18, the appropriate brackets 70, 72, each of which has either a push or a pull handle, and has a cam 58, 59 with a central opening 60 sized to receive the key 30 of the manufacturer of the lock are fitted over the distal ends of the key and retained in place by bolts 74—74 extending through the brackets 70, 72 and threaded into the aligned second plurality of holes 90—90. Finally, covers 118, 120 can be fitted over the brackets 70, 72 and retained by any appropriate means.

Figure 11:
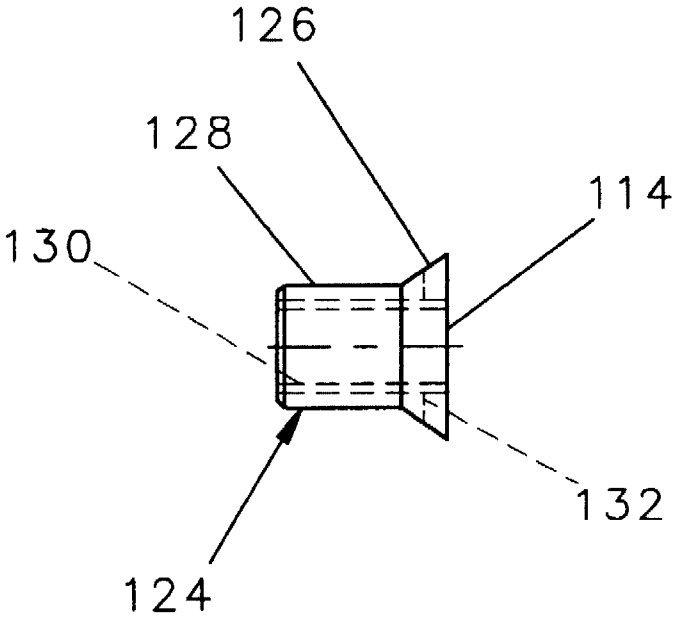
FIG. 11 is a front end view of the nut shown in FIG. 10.
Figure 10:
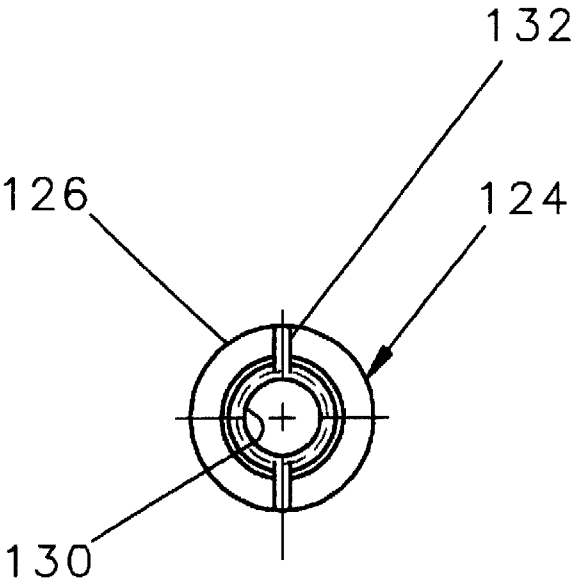
FIG. 10 is an enlarged side view of a second embodiment of a mounting nut.

Referring to FIGS. 10 and 11, an alternate embodiment of a nut 124 has a frustoconical outer portion 126 and a tubular inner portion 128, and extending axially through the nut 124 is a threaded hole 130 which is complementary to the threads of the bolts 103. In this embodiment a transverse slot 132 in the outer end of the outer portion 126 is sized to receive the end of standard size screw drivers. A nut 124 can be tightened onto a bolt 103 by inserting a screwdriver into the slots in the distal ends of both the nut 124 and the bolt 103, and turning one with respect to the other. As with the nut of the first embodiment 106, the frustoconical portion 126 and the cylindrical portion 128 are sized such that the cylindrical portion 126 will slide through one of the holes 88A–88H and the frustoconical portion 126 will seat in the corresponding taper 99 of the holes 88A–88H, and the outer surface of the nut 124 will be flush with the outer surface 98 of the plate 84.

While the present invention has been described in connection with two embodiments, it will be understood that changes and modifications may be made without departing from the true spirit and scope of the present invention. Therefore, it is intended by the pending claims to cover all such changes and modifications which come within the true spirit and scope of the present invention.

What is claimed:

1. An adapter plate for mounting a push/pull handle type door lock assembly on a door having one of several differing lock mortises positioned thereon, wherein said lock mortise is retained between a first and a second side surface of a door, said lock mortise including a central hole therethrough for mounting a mortise operating key therein, and a pair of apertures on opposite sides of said central hole at predetermined radial distances therefrom and predetermined arcuate positions therearound, said adapter plate comprising in combination:

a generally planar plate body having a central opening aligned with a central hole in a lock mortise, said plate body having four pairs of apertures extending transversely therethrough, including a pair of apertures positioned along each of a first set of lines running horizontally, respectively, and vertically, respectively, across said central opening, and a pair of apertures positioned along each of a second set of perpendicular lines passing across said central opening, said second set of lines being oriented 45 degrees arcuately from said first set of lines, said pair of apertures extending through said lock mortise being alignable with at least one respective pair of said plurality of pairs of apertures through said plate body, a pair of connector means for extending through respective ones of said apertures through said plate body and respective ones of said pair of apertures through said lock mortise for retaining same together, and mounting means on said plate body for mounting a push/pull handle type door lock assembly thereon.

2. A mounting plate in accordance with claim 1 wherein two pairs of apertures have centers spaced 1.516 inches from each other, respectively, as measured along said first set of lines, and two pairs of apertures have centers spaced 1.532 inches from each other, respectively, as measured along said second set of lines.

3. A mounting plate in accordance with claim 1 wherein said four pairs of apertures have centers spaced 1.688 inches from each other, respectively, as measured along one of said first and said second sets of lines.

4. A pair of adapter plates for mounting a pair of push/pull handle type door lock assemblies on a door having one of several differing lock mortises positioned thereon, wherein said lock mortise is retained between a first and a second side surface of said door, said lock mortise including a central hole therethrough for mounting a mortise operating key therein, and a pair of apertures through said lock mortise on opposite sides of said central hole at predetermined radial distances therefrom and predetermined arcuate positions therearound, said pair of adapter plates comprising in combination:

a pair of planar plate bodies, each having a central opening alignable with a central hole in said lock mortise, said plate bodies having a plurality of aligned pairs of apertures extending transversely therethrough, a pair of apertures extending through said lock mortise being alignable with at least one respective pair of said plurality of aligned pairs of apertures through each of said plate bodies, a pair of connector means for extending through respective ones of said aligned pairs of apertures through said pair of adapter plates and respective ones of a pair of apertures through said lock mortise for retaining same together, and mounting means on each of said plate bodies for mounting a push/pull handle type door lock assembly thereon.

5. The pair of adapter plates as defined in claim 4 wherein said plurality of pairs of apertures in one of said plates includes a tapered surface therein.

6. The pair of adapter plates as defined in claim 4 wherein said plurality of pairs of apertures in the other of said plates is non-circular in shape.

7. The pair of adapter plates as defined in claim 4 wherein said plurality of pairs of apertures in one of said plates includes a tapered surface therein and said plurality of pairs of apertures in the other of said plates is non-circular in shape.

8. The pair of adapter plates as defined in claim 4 wherein said connector means includes a rod member having an elongate rod shape body and an enlarged head at one end thereof, said head being tapered outwardly axially and radially from said body and having an axial thickness not greater than the thickness of one of said adapter plates for providing a flat surface on which to mount a push/pull handle type door lock assembly.

9. The pair of adapter plates as defined in claim 4 wherein said connector means includes a nut-like member having a non-circular outer surface and a thickness not greater than the thickness of the other of said adapter plates for providing a flat surface on which to mount a push/pull handle type door lock assembly.

10. The method of adapting a door latch mechanism including rotatable type handles to receive push/pull type handle assemblies, where said latch mechanism has a mortise including a central hole transversely therethrough including a mortise operating key positioned therein retained between first and second side panels of a door, and said rotatable type handles are mounted on said mortise key, said method comprising the steps of:

removing the rotatable type handles from said latch mechanism, positioning an adapter plate on each of first and second panels of said door, each said adapter plate having a planar body including a plurality of aligned pairs of apertures extending transversely therethrough, a pair of apertures extending through a lock mortise being alignable with at least one respective pair of said plurality of aligned pairs of apertures through each of said plate bodies, securing said adapter plates against said first and second door side panels by extending a pair of connector means through respective ones of said aligned pairs of apertures through said pair of adapter plates and respective ones of a pair of apertures through said lock mortise, and mounting a push/pull handle type door lock assembly on each said adapter plate with said push/pull handle in operative communication with said key.

* * * * *